US008236742B2

(12) United States Patent
Goto et al.

(10) Patent No.: US 8,236,742 B2
(45) Date of Patent: Aug. 7, 2012

(54) METAL WORKING OIL COMPOSITION, METAL WORKING METHOD AND METAL WORK

(75) Inventors: Koichi Goto, Fujisawa (JP); Kazuyoshi Takeda, Fujisawa (JP)

(73) Assignee: Kyodo Yushi Co., Ltd., Kanagawa (JP)

( * ) Notice: Subject to any disclaimer, the term of this patent is extended or adjusted under 35 U.S.C. 154(b) by 173 days.

(21) Appl. No.: 12/241,370

(22) Filed: Sep. 30, 2008

(65) Prior Publication Data

US 2009/0018039 A1 Jan. 15, 2009

Related U.S. Application Data

(63) Continuation of application No. PCT/JP2007/056575, filed on Mar. 28, 2007.

(30) Foreign Application Priority Data

Mar. 30, 2006 (JP) ..... 2006-094425

(51) Int. Cl.
*C07F 9/165* (2006.01)
*C10M 169/04* (2006.01)
*B26D 7/08* (2006.01)

(52) U.S. Cl. ..... 508/428; 508/440; 83/22; 83/169

(58) Field of Classification Search ..... 508/428, 508/440; 83/22, 169
See application file for complete search history.

(56) References Cited

U.S. PATENT DOCUMENTS

| | | | | |
|---|---|---|---|---|
| 3,618,461 | A * | 11/1971 | Parker | 409/131 |
| 5,338,471 | A | 8/1994 | Lal | |
| 5,358,652 | A | 10/1994 | MacPherson | |
| 5,413,725 | A | 5/1995 | Lal et al. | |
| 5,487,838 | A * | 1/1996 | Luciani et al. | 508/188 |
| 5,858,933 | A * | 1/1999 | Nikoloff | 508/428 |
| 2002/0035043 | A1 | 3/2002 | Yokota et al. | |
| 2004/0053791 | A1 * | 3/2004 | Langer et al. | 508/154 |
| 2004/0116309 | A1 | 6/2004 | Yokota et al. | |
| 2004/0235679 | A1 | 11/2004 | Kurosky et al. | |
| 2004/0242435 | A1 | 12/2004 | Nishimura et al. | |
| 2005/0245404 | A1 | 11/2005 | Repo | |
| 2005/0288195 | A1 | 12/2005 | Heenan et al. | |

FOREIGN PATENT DOCUMENTS

JP 09-057537 3/1997

(Continued)

OTHER PUBLICATIONS

International Search Report for PCT/JP2007/056575, mailed Jul. 3, 2007.

(Continued)

*Primary Examiner* — Walter D Griffin
*Assistant Examiner* — Vishal Vasisth
(74) *Attorney, Agent, or Firm* — Nixon & Vanderhye P.C.

(57) ABSTRACT

A metal working oil composition which is used for a very small amount of oil-feeding type metal working methods comprising a base oil selected from the group consisting of natural fats, derivatives thereof and synthetic ester oils, and a phospholipid is disclosed. The metal working oil composition of the present invention has good lubricating properties and is suitable for processing metallic materials such as cast irons steel, stainless steel and the like by the very small amount of oil-feeding type metal working method.

9 Claims, 1 Drawing Sheet

FOREIGN PATENT DOCUMENTS

| | | |
|---|---|---|
| JP | 10-292190 | 11/1998 |
| JP | 2000-219890 | 8/2000 |
| JP | 2000-248289 | 9/2000 |
| JP | 2000-256688 | 9/2000 |
| JP | 2001-239437 | 9/2001 |
| JP | 2004-300317 | 10/2004 |
| WO | WO 01/30945 | 5/2001 |
| WO | WO 02/081605 | 10/2002 |
| WO | WO 2004/106474 | 12/2004 |

OTHER PUBLICATIONS

Written Opinion of the International Searching Authority for PCT/JP2007/056575, mailed Jul. 3, 2007.
European Search Report issued for European Patent Application No. 07740013.3, dated Feb. 16, 2011.
Gunstone, et al., "Lipid Technologies and Applications," Chapter 3: Phospholipids, Dekker, New York, US, Jan. 1, 1997, XP009135311, ISBN: 978-0-8247-9838-3, pp. 51-78.

* cited by examiner

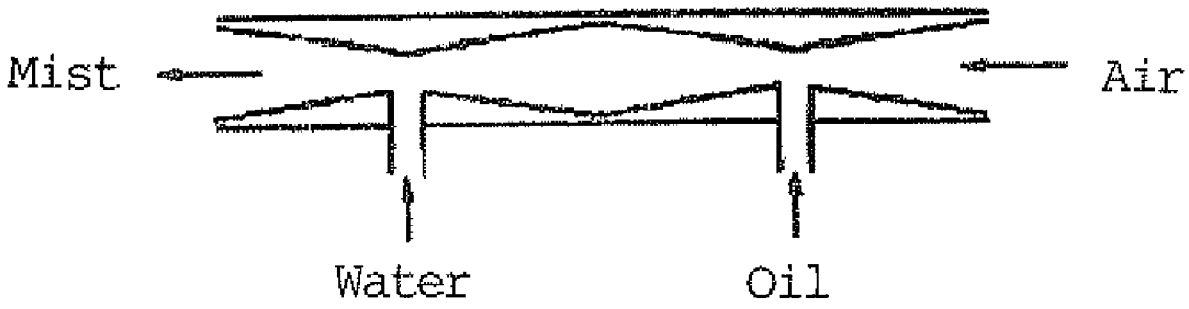
Mist
Air
Water
Oil

METAL WORKING OIL COMPOSITION, METAL WORKING METHOD AND METAL WORK

This application is a continuation of International Application No. PCT/JP2007/056575, filed 28 Mar. 2007, which claims priority to Japan Patent Application No. 2006-094425, filed 30 Mar. 2006, the entire contents of each of which are hereby incorporated by reference.

TECHNICAL FIELD

The present invention relates to a metal working oil composition, and more particularly to a metal working oil composition which is used for a very small amount of oil-feeding type metal working method and which is widely applicable to metal workings such as cutting, grinding, component rolling, press working and plastic working. The present invention further relates to a metal working method and metal work obtained by the metal working method.

BACKGROUND ART

In recent years, studies are underway on dry processes for cutting process, grinding process and the like as environmentally friendly methods for metal working processes. When metal working is conducted in a dry condition, the processing point needs to be cooled. The processing point is cooled, for example, by spraying compressed cooling air or the like. However, since a completely dry process lacks lubricity between the instrument and a work material, a very small amount of lubricating oil is supplied. Examples of the working method include a processing method for nonferrous metal (for example, see Patent Document 1), conventionally known metal working oil compositions (for example, see Patent Document 2, 3) and the like. As for these metal working oil, a new working oil which is capable of further improving workability, extending the life span of the instrument and reducing the amount of oil to be supplied is desired in view of increasing the productivity and/or saving energy. A metal working fluid to which phosphatidyl choline is added is also known (see Patent Document 4).

Patent Document 1 JP 2001-239437 A
Patent Document 2 JP 2000-256688 A
Patent Document 3 JP 2004-300317 A
Patent Document 4 JP 09-57537 A

DISCLOSURE OF THE INVENTION

Problems to be Solved by the Invention

An object of the present invention is to provide a metal working oil composition that has good lubricating properties and is suitable for metal working of metallic materials such as cast iron, steel, stainless steel by a very small amount of oil feeding metal working method; metal working method; and metal work.

Means for Solving the Problem

In order to attain the above-mentioned object, the present inventors intensively studied to discover that a metal working oil composition comprising a base oil selected from the group consisting of natural fats and ester oils, and a phospholipid has good lubricating properties and is suitable for the very small amount of oil-feeding type metal working of metallic materials such as cast iron, steel, stainless steel and the like, thereby completing the present invention.

The present invention provides the following metal working oil composition, metal working methods and metal works.

1. A metal working oil composition which is used for a very small amount of oil-feeding type metal working method, said composition comprising a base oil selected from the group consisting of natural fats, derivatives thereof and synthetic ester oils, and a phospholipid.
2. The metal working oil composition according to the above-described item 1, wherein the phospholipid comprises at least one selected from the group consisting of egg-yolk lecithin, soybean lecithin and the like.
3. The metal working oil composition according to the above-described item 1 or 2, wherein the phospholipid contains a mixture of phosphatidylcholine, phosphatidylethanolamine and phosphatidylinositol.
4. The metal working oil composition according to any one of above-described items 1 to 3, wherein said composition contains said phospholipid in an amount of 0.1 to 40% by mass.
5. The metal working oil composition according to any one of above-described items 1 to 4, wherein the very small amount of oil-feeding type metal working method is a method by which metallic materials are processed while supplying, by a compressed fluid, water drops whose surface is covered with an oil film.
6. The metal working oil composition according to any one of above-described items 1 to 4, wherein the very small amount of oil-feeding metal working method is a method by which metallic materials are processed while transforming the metal working oil into a form of mist and supplying the mist by a compressed fluid.
7. A very small amount of oil-feeding type metal working method, comprising processing a metallic material using the metal working oil composition according to any one of above-described items 1 to 6.
8. The metal working method according to the above-described item 7, wherein metallic materials are processed while supplying, by a compressed fluid, water drops covered with the metal working oil composition according to any one of the above-described items 1 to 6.
9. The metal working method according to the above-described item 7, wherein metallic materials are processed while transforming the metal working oil composition according to any one of the above-described items 1 to 6 into a form of mist and supplying the mist by a compressed fluid.
10. A metal work obtained by the metal working method according to any one of the above-described items 7 to 9.

Effects of the Invention

By the metal working oil composition of the present invention and by the metal working method, cutting, grinding, component rolling, press working, plastic working and the like of metallic materials may be performed efficiently. Further, an economical and low environmental load process may be carried out because the amount of the oil used is very small. The metal work obtained by the metal working process of the present invention has good accuracy of finishing.

BEST MODE FOR CARRYING OUT THE INVENTION

The present invention will now be described in detail,

The present invention relates to a metal working oil composition which is used for the very small amount of oil-feeding type metal working method the composition being characterized by comprising a base oil selected from the group consisting of natural fats and ester oils; and phospholipids.

The base oil used for the metal working oil composition of the present invention is selected from the group consisting of natural fats, derivatives thereof and synthetic ester oils. Examples of the natural fats include rapeseed oil, soybean oil, castor oil, palm oil, lard and the like. Examples of the derivatives of natural fats include hydrogenated products such as hydrogenated rapeseed oil, hydrogenated soybean oil, hydrogenated castor oil, hydrogenated palm oil, hydrogenated lard and the like; and alkylene oxide-added castor oil and the like. Examples of synthetic ester oils include ester series synthetic oils typified by polyol ester. The base oil of the present invention may also include a naphthene series or paraffin series mineral oil; synthetic hydrocarbon oil typified by poly α-olefin, polybutene; ether series synthetic oil typified by alkyl diphenyl ether and polypropylene glycol; silicon oil; fluorinated oil and the like. It should be noted, however, that the principle component of the base oil of the present invention is selected from the group consisting of natural fats, derivatives thereof and synthetic ester oils, and that these component account for 70% by mass, preferably 90% by mass, more preferably 90% by mass. Ester oils are most preferable from the viewpoint of lubricating properties and adsorptive properties to the newly generated surface. The ester oil has a polar group in the molecule thereof and therefore the ester oil constitutes an adsorption film which has good lubricating properties on the metal surface.

The phospholipid used for the metal working oil composition of the present invention includes egg-yolk lecithin, soybean lecithin and the like. Egg-yolk lecithin, and soybean lecithin are commercially available in the form of powder which is highly purified and in the form liquid which is poorly purified. The commonly called lecithin refers to those in the paste form. This lecithin is a mixture of phospholipids such as phosphatidylcholine, phosphatidylethanolamine, phosphatidylinositol and the like and triglyceride (mainly soy-bean oil).

The phospholipids used for the metal working oil composition of the present invention may be in any forms. Since the phospholipids in paste form are easy to dissolve in the base oil, they are suitable for producing the oil. Phospholipids are commercially available and the commercially available products may be used in the present invention. Examples of such commercially available products include J lecithin CL (trade name) (AJINOMOTO CO., INC), Lecithin DX (Nisshin Oil Mills, Ltd.) and the like.

The content of phospholipids in the metal working oil composition of the present invention is preferably 0.1 to 40% by mass, more preferably 0.2 to 35% by mass, and most preferably 0.5 to 30% by mass based on the total weight of the composition. When the content of phospholipids is less than the above range, it is difficult to obtain expected lubricating properties.

To the metal working oil composition of the present invention, widely used components of the metal working oil composition such as load-bearing additives, anticorrosive, metal deactivators and antioxidants may further be added as required. The amount of the components to be added is preferably 10% by mass or less based on the total composition.

The metal working oil composition of the present invention may easily be produced by adding specific amounts of phospholipids and optionally other components to the base oil. As a preferred mode of feeding the very small amount of metal working oil composition in the very small amount of oil-feeding type metal working method for carrying out the above-described method according to the present invention, the following methods are preferable:

1. A method of supplying, by a compressed fluid (e.g., air), water drops whose surface is covered with the metal working oil composition.
2. A method of supplying, by a compressed fluid (e.g., air), a mixed mist of water and the metal working oil composition.
3. A method of transforming water and the metal working oil composition in the form of mists in separate systems and supplying, by a compressed fluid (e.g., air), the mists at the same location.
4. A method of transforming the metal working oil composition in the form of a mist and supplying, by a compressed fluid (e.g., air), the mist.

The method 1 is most preferred. The method of the present invention will now be described in detail by way of the method 1, but the method of the present invention is not restricted thereto. Examples of feeding apparatus for carrying out the method 1 include those disclosed in JP 2001-239437 A. The schematic structure of one example of the feeding apparatus is shown in FIG. 1. Mist consisting of particles which are water drops on whose surface an oil film is formed is produced in such an apparatus by utilizing the same principle as the principle used by a usual spray. At this time, an oil film is efficiently formed on the surface of water drops by inhaling oil on the site near the inlet of air and inhaling water on the site near the outlet.

Examples of methods of processing metallic materials while feeding the metal working oil composition of the present invention include cutting, grinding, shearing, end milling, component rolling, press working, plastic working and the like. Examples of metallic materials include cast iron, steel, stainless steel and the like.

The amount of the metal working oil composition of the present invention used is as small as 0.5 to 20 mL, preferably 1 to 10 mL per one nozzle per hour. Therefore, the environmental load is low and it is economically advantageous. The amount of water used is 500 to 2000 mL, preferably 800 to 1500 mL, and for example, 1000 mL per hour per one nozzle. The water used may be tap water or industrial water. The amount of air supplied is suitably about 25 to 250 L, preferably about 50 to 100 L per minute.

Further, in the processing method of the present invention, it is desirable that the low environmental load metal working oil composition of the present invention be used in a very small amount for a single-use. By so doing, problems in the conventional processes in which water-soluble cutting oil is used, namely, decomposition of diluent of water-soluble cutting oil, deterioration of processing solution, such as separation due to an increase in hardness or the like, reduced processing performance due to the above decomposition and/or deterioration, environmental load of waste fluid of the water-soluble cutting oil diluent may also be mitigated or overcome.

The present invention will now be described in more detail by way of examples. However, the present invention is not restricted to the following examples. The modified examples which do not depart from the spirit of the present invention are also included in the scope of the present invention.

EXAMPLES

A metal working oil composition according to the formulation shown in Table 1 was prepared, then cutting tests were performed while supplying the composition under the conditions shown in Table 1, followed by evaluation of the cutting performance. In Examples 1 to 3 and Comparative Example 1 and 2, water drops whose surface is covered with an oil film was supplied by air. In Comparative Example 3, a commercially available emulsion cutting oil (JIS WI class No. 2 emulsion cutting oil) (5% by mass) is supplied at a discharge pressure of 1 kg/cm$^2$ and a feed rate of 6 L/min.

Evaluation of Cutting Performance

The cutting performance was evaluated by turning operation of carbon steel (S45C). Cutting resistance (N) was perpendicular to feed direction (tool pressing force). If the cutting resistance is lower than that of lubricant of Comparative Example 1, the lubricant satisfies the standard.

Cutting Conditions

Tools: carbide 6 blades, torsion angle: 45°, rake angle: 14°, tip: IR)

Work Material: SKD11 (HRC53) (30×150×200 mm)

Cutting Speed: 300 m/min

Feed: 0.1 mm/blade

Radius Depth of Cut: 0.5 mm

Axial Depth of Cut: 10 mm

In Table 1, blending formulations of Examples and Comparative Examples, and the results of the evaluation test are shown. From the results shown in Table 1, it is seen that the metal working oil compositions of Example 1 and 2 of the present invention have low cutting resistance and has good lubricating properties.

TABLE 1

| | | Ex. 1 | Ex. 2 | Ex. 3 | Comp. Ex. 1 | Comp. Ex. 2 | Comp. Ex. 3 |
|---|---|---|---|---|---|---|---|
| phospholipid*1 | | 0.5 | 10.0 | 30.0 | — | — | emulsion |
| rape seed oil*2 | | 89.5 | 90.0 | 70.0 | 90.0 | 100 | cutting |
| 2-ethylhexyl oleate | | 10.0 | — | — | 10.0 | — | oil |
| feed | oil (ml/H) | 10 | 10 | 10 | 10 | 10 | |
| rate | water (ml/H) | 1000 | 1000 | 1000 | 1000 | 1000 | |
| | air (L/min) | 100 | 100 | 100 | 100 | 100 | |
| cutting resistance (N) | | 385 | 370 | 360 | 400 | 420 | 440 |

*1 phospholipid: J lecithin CL (trade name) (AJINOMOTO CO., INC)

*2 rape seed oil: acid value 0.08 (mg KOH/g)

BRIEF DESCRIPTION OF THE DRAWINGS

FIG. 1 is a schematic diagram showing one example of apparatus which supply, by air, water drops whose surface is covered with an oil film and which may be used in the method of the present invention.

What is claimed is:

1. An oil-feeding type metal working method, comprising processing a metallic material using a metal working oil composition which comprises a base oil selected from the group consisting of natural fats, derivatives thereof and synthetic ester oils; and a phospholid, wherein the metal working is cutting, grinding, component, rolling, or press working and the metallic material is processed while supplying, by a compressed air, water drops covered with the metal working oil composition, wherein the metallic material is selected from the group consisting of cast iron, steel, and stainless steel, and wherein the step of supplying, by the compressed air, water drops covered with the metal working oil composition is generated by feeding 0.5 to 20 mL/hr of the metal working oil composition to a nozzle, feeding 500 to 2000 mL/hr of the water to the nozzle, and feeding 25 to 250 L/min of the air to the nozzle.

2. The metal working method according to claim 1, wherein the phospholipid comprises at least one selected from the group consisting of egg yolk lecithin, and soybean lecithin.

3. The metal working method according to claim 1, wherein the phospholipid contains a mixture of phosphatidylcholine, phosphatidylethanolamine and phosphatidylinositol.

4. The metal working method according to claim 1, wherein said composition contains said phospholipid in an amount of 0.1 to 40% by mass.

5. The metal working method according to claim 1, wherein metallic materials are selected from the group consisting of cast iron, steel, and stainless steel, wherein the phospholipid comprises at least one selected from the group consisting of egg-yolk lecithin, and soybean lecithin, wherein said composition contains said phospholipid in an amount of 0.1 to 40% by mass, and wherein the metallic materials are processed while supplying, by a compressed fluid, water drops whose surface is covered with the metal working oil composition.

6. The metal working method according to claim 1, wherein metallic materials are selected from the group consisting of cast iron, steel, and stainless steel, wherein the phospholipid comprises at least one selected from the group consisting of egg-yolk lecithin, and soybean lecithin, wherein said composition contains said phospholipid in an amount of 0.1 to 40% by mass, and wherein the metallic materials are processed while transforming the metal working oil into a form of mist and supplying the mist by a compressed fluid.

7. The metal working method according to claim 5, wherein the metal working is cutting or grinding.

8. The metal working method according to claim 6, wherein the metal working is cutting or grinding.

9. The metal working method according to claim 1, wherein the supplying, by a compressed air, water drops covered with the metal working oil composition is generated by feeding the compressed air into an inlet of the nozzle, feeding the metal working oil composition to the compressed air to the nozzle so as to form a mixture of oil and air in the nozzle, feeding water to mixture of the oil and air in the nozzle, and removing the water drops covered with the metal working oil composition through an outlet of the nozzle.

* * * * *